United States Patent [19]

Kasler et al.

[11] Patent Number: 4,988,233

[45] Date of Patent: Jan. 29, 1991

[54] PAVING MACHINE

[75] Inventors: Richard E. Kasler, Long Beach; Danny J. O'Bryan, Yucaipa, both of Calif.

[73] Assignee: Kasler Corporation, San Bernadino, Calif.

[21] Appl. No.: 292,227

[22] Filed: Dec. 30, 1988

[51] Int. Cl.[5] ..... E01C 19/00

[52] U.S. Cl. ..... 404/108; 404/84

[58] Field of Search ..... 404/84, 101, 106, 108, 404/119, 104

[56] References Cited

U.S. PATENT DOCUMENTS

| | | | |
|---|---|---|---|
| 3,210,710 | 10/1965 | Amos | 404/108 |
| 3,791,753 | 2/1974 | Rymsa | 404/84 |
| 3,967,912 | 7/1976 | Parker | 404/108 X |
| 4,197,032 | 4/1980 | Miller | 404/98 |
| 4,534,674 | 8/1985 | Cutler | 404/108 X |

FOREIGN PATENT DOCUMENTS

| | | | |
|---|---|---|---|
| 2135957 | 2/1973 | Fed. Rep. of Germany | 404/108 |

OTHER PUBLICATIONS

Product description of Gomaco Corporation for a minimum clearance mold assembly; Mar. 1990.

*Primary Examiner*—William P. Neuder

*Attorney, Agent, or Firm*—Gordon L. Peterson; Loyal M. Hanson

[57] ABSTRACT

A paving machine for zero or minimum clearance applications includes a tractor for moving a pan assembly in a desired direction of travel on a roadway to be paved in order to form a quantity of concrete mud into a slab of desired width and elevation. The pan assembly has a pan that extends laterally substantially the full desired width and rearwardly from a leading edge portion of the pan to a trailing edge portion of the pan. Components are provided for mounting the pan assembly on the tractor so that the leading edge portion of the pan is disposed rearwardly of at least one of the left and right tracks. Multiple sensors may be included for independent elevation control of the pan along with mounting components for lateral adjustment of the pan assembly and dual screeds for better control of the concrete mud.

33 Claims, 4 Drawing Sheets

PAVING MACHINE

BACKGROUND OF THE INVENTION

1. Technical Field

This invention relates generally to construction equipment, and more particularly to a machine for laying or placing a concrete slab where there is little or no side clearance.

2. Background Information

A paving machine or slipform paver, such as those commonly used to place concrete highways, includes a pan assembly that is supported by a frame structure on a tractor or other prime mover. As the tractor inches forward along a roadway to be paved, the left and right tracks straddle a supply of concrete dumped onto the roadway in a hopper arrangement on the front of the tractor and one or more augers move the concrete transversely across the pan assembly. There, an extrusion-process pan on the pan assembly rides over the concrete, working it into a finished slab while sensor-controlled hydraulics attempt to maintain just the right slab elevation or thickness. This is done to place many miles of pavement so that the details of paving machine construction are of interest.

The pan has a downwardly facing planar surface that extends laterally across the width of the slab and rearwardly from a leading edge that is disposed toward the hopper to a trailing edge. The leading edge is slightly higher than the trailing edge so that the pan extrudes the concrete rearwardly. In this regard, the pan can be thought of as working the concrete somewhat like a trowel.

One problem with some existing paving machines concerns operation of the pan when the roadway to be paved has little or no clearance along one or both of its sides. Such minimum or zero clearance paving may occur, for example, when the roadway to be paved provides a new traffic lane alongside an existing traffic lane or extends to curbing that has already been poured. In such cases, the roadway extends up to an existing structure so that the new pavement will abut the existing structure.

Thus, there is little or no clearance on the sides, and this presents a problem because the left and right tracks must ride on the roadway to be paved. With the tracks riding on the roadway, the pan, which lies in between the tracks, cannot cover the full width of the roadway. Thus, unpaved strips remain, one behind each of the left and right tracks.

Some existing paving machines include left and right pan extensions behind the tracks in order to solve this problem, along with an auger system that employs five augers to move the concrete rearwardly to the pan extensions. Other existing paving machines designed for one-sided minimum clearance applications employ a four-track tractor having the rearward track removed on the minimum clearance side and a pan extension installed in the area of the removed track. This enables the pan to be extended behind the front track on that one side.

In either case, a pan extension extends behind at least one of the left and right tracks and this introduces certain other problems. In particular, and apart from being somewhat inconvenient and complicated, it may cause poor elevation control. In other words, control of pan position may be affected so that the elevation of the slab is difficult to control.

Consider, for example, the sensor-controlled hydraulics of an existing paving machine. They may include one or more sensors mounted on the frame structure, each having a wand or sensor arm that rides on a wire strung alongside and at a known elevation above the roadway to be paved (sometimes referred to as a null position). Electrical control circuitry responsive to signals produced by the sensors causes hydraulic cylinders to adjust the height of the frame structure and thus the pan until the arm of each sensor is riding on the wire at the null position (causing what is sometimes called a null condition). This is done in an effort to maintain the pan at the desired elevation.

However, when pan extensions are added behind the tracks, sensor arm height does not accurately reflect the height of the pan extensions. In other words, the pan extensions can move vertically a significant distance without the sensor arm moving the same amount because of the lever arm between the sensor arm and the rearwardly disposed pan extensions. This is aggravated by the tendency of the pan extensions to float on the concrete mud and the tendency for mud consistency to vary from batch to batch. Poor elevation control results.

Consequences of poor elevation control may be severe and include the cost of unneeded concrete and the need to grind down significant stretches of new pavement in order to blend into the existing grade. Thus, it is desirable to have a new and improved paving machine that overcomes the above concerns.

Another problem with some existing paving machines concerns obstacles along the roadway. Obstacles such as sewage and drainage structures may exist along the roadway in the path of the tractor and with existing paving machines it may be necessary to stop paving, veer around the obstacle, and then resume paving on the other side of it. This is inconvenient and it adds cost to the project. Thus, it is desirable to have a paving machine that alleviates this concern as well.

SUMMARY OF THE INVENTION

This invention solves the problems outlined above by mounting a pan assembly on a tractor so that the pan is entirely behind the tracks and by mounting leading edge sensors and trailing edge sensors on the pan in positions that avoid the lever arm problem of the prior art and better reflect pan position. Thus, the invention enables zero and minimum clearance paving to be accomplished conveniently with improved elevation control. In addition, the pan assembly is mounted so that it can be adjusted laterally. Thus, the tractor can veer around obstacles while paving continues with the pan assembly remaining on course.

Generally, a paving machine constructed according to the invention includes a tractor or prime mover for moving a pan assembly in a desired direction of travel on a roadway to be paved, the tractor having left and right tracks. The pan assembly forms a quantity of concrete mud into a slab so that the slab has a desired width and elevation. The pan assembly includes a pan that extends laterally substantially the full desired width and rearwardly from a leading edge portion of the pan to a trailing edge portion of the pan.

According to a major aspect of the invention, components are provided for mounting the pan assembly on the tractor so that the leading edge portion of the pan is disposed rearwardly of at least one of the left and right tracks. These components may take the form of a cantilever beam assembly mounted on a frame structure of the tractor to provide an overhead support structure for the pan assembly together with a lateral beam assembly mounted on the cantilever beam assembly. The lateral beam assembly supports the pan assembly with hydraulic cylinders that operate to maintain the pan at the desired elevation.

According to another aspect of the invention, there are provided components for adjusting the elevation of the pan assembly in order to maintain the desired elevation. These components may take the form of conventional sensor devices that sense when the pan is at the desired elevation by riding on a wire strung at the null position alongside the roadway. The sensor devices are advantageously positioned to overcome the lever arm problem described above, one embodiment including left and right forward sensor devices and left and right rearward sensor devices connected to the four corners of the pan.

According to yet another aspect of the invention, there are provided left and right arm assemblies that support the left and right rearward sensor devices rearwardly of the trailing edge of the pan a substantial distances. This further improves elevation control.

According to still other aspects, the pan assembly can be moved laterally relative to the tractor. This enhances operation along a radius or in the presence of obstacles on the roadway. One embodiment is configured to enable adjustment of the width of the pan assembly. In addition, a rear screed is provided intermediate the tracks and the leading edge of the pan to provide even better elevation control.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figure 1:
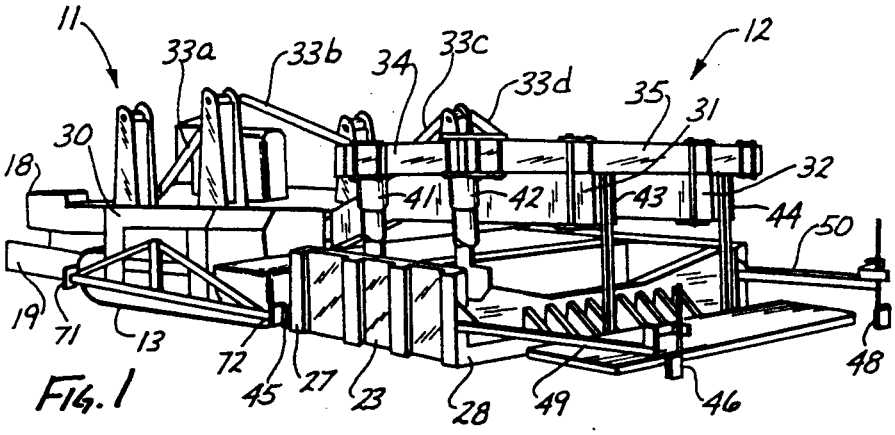
FIG. 1 of the drawings is a perspective view of a paving machine constructed according to the invention.

Referring now to the drawings, there is shown a paving machine or machine 10 constructed according to the invention. Generally, the machine 10 includes a prime mover or tractor 11, a pan assembly 12, and components for mounting the pan assembly 12 on the tractor 11 in a manner subsequently described so that the pan assembly 12 is positioned rearwardly of the tractor 11. These are constructed in a manner suitable for heavy equipment to be used in paving a highway, such as the slipform pavers available from Gomaco Corporation of Ida Grove, Iowa and CMI Corporation of Oklahoma City Okla.

Figure 5:
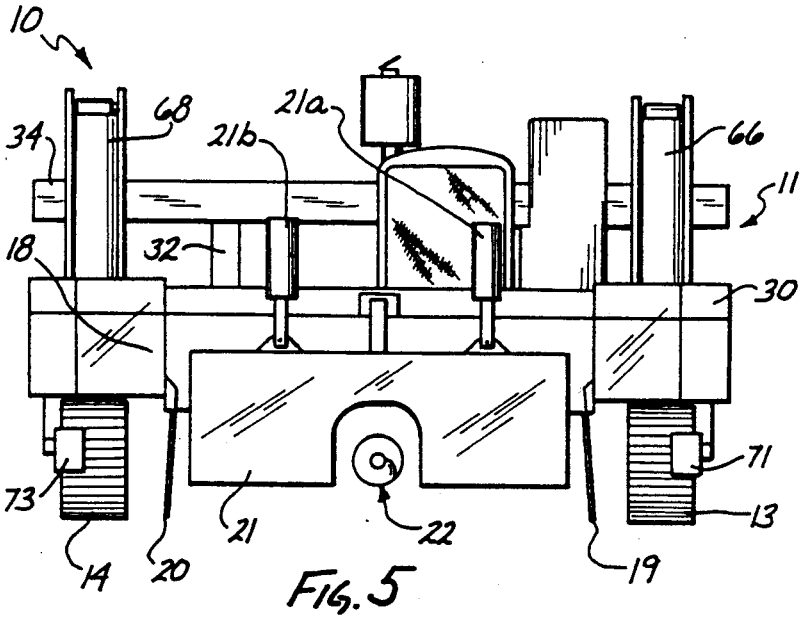
FIG. 5 is front view.
Figure 6:
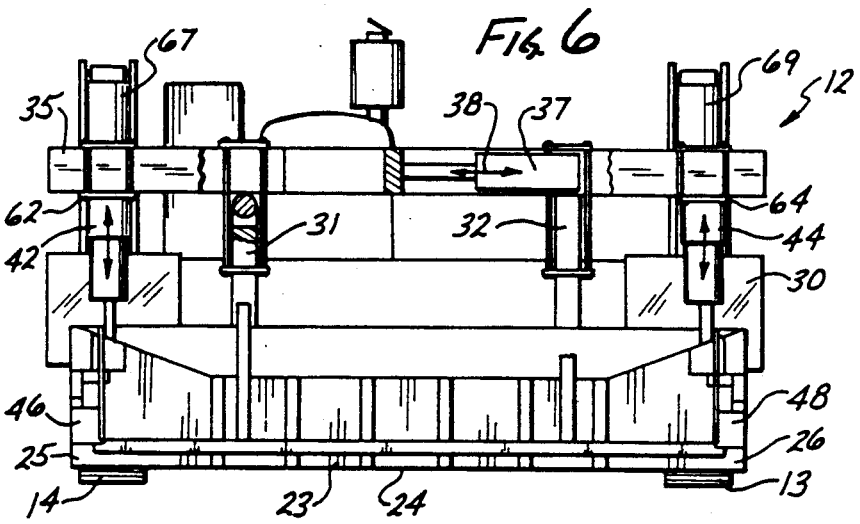
FIG. 6 is a rear view.

The tractor 10 may be any type of prime mover and it is conventional in many respects, taking any of the various known forms commonly used prime mover of a paving machine. It includes left and right roadway contacting members or tracks 13 and 14, both tracks being visible in FIGS. 4–6, and it operates conventionally to move the pan assembly 12 in a desired direction of travel on a roadway 15 to be paved as depicted by an arrow 16 in FIG. 2 (down the roadway intermediate left and right sides of the roadway). In other words, the tractor 11 moves the pan assembly 12 over the roadway 15 in order to form a slab to a desired elevation. Of course, any of various track arrangements may be utilized within the inventive concepts disclosed, and the left and right tracks 13 and 14 of the paving machine 10 may include any type of caterpillar tractor track having a continuous belt over cogged wheels as well as any other type of tractor wheel (the invention does not depend on the type of prime mover or the wheel arrangement).

As the tractor moves down the roadway, the left and right tracks 13 and 14 straddle a supply of concrete mud 17 (raw, unset concrete) dumped onto the roadway 15 in a hopper arrangement 18 on the front of the tractor 11 (FIGS. 2–5) between left and right headers 19 and 20 while a forward screed 21 functions conventionally to help level the concrete mud 17 and an auger assembly 19 moves it transversely across the pan assembly 12. In that regard, suitable means such as hydraulic cylinders **21*a* and 21*b* (FIG. 5) operate conventionally to move the screed 21 to a selected elevation with a longitudinal portion 22*a* and a lateral portion (not shown) of the auger assembly 22 (FIG. 3) cooperating to move the concrete mud 17** as desired.

As the tractor 12 continues to move forwardly over the concrete mud 17, an extrusion-process pan 23 on the pan assembly 12 rides over the concrete mud 17, working it into a finished slab **17*a* (FIG. 2) of desired width (the width of the roadway to be paved) and elevation (the elevation of an upper surface 17*b* of the slab 17*a*). The pan 23 has a downwardly facing planar surface 24 (FIGS. 2 and 6) that extends substantially the full desired width laterally (across the roadway perpendicular to the direction of travel) between left and right side portions 25 and 26 of the pan 23 (FIGS. 4 and 6) and rearwardly (opposite the direction of travel) from a leading edge portion 27 of the pan 23 that is disposed toward the tractor 11 to a trailing edge portion 28 of the pan 23 (FIGS. 2 and 4**).

Figure 2:
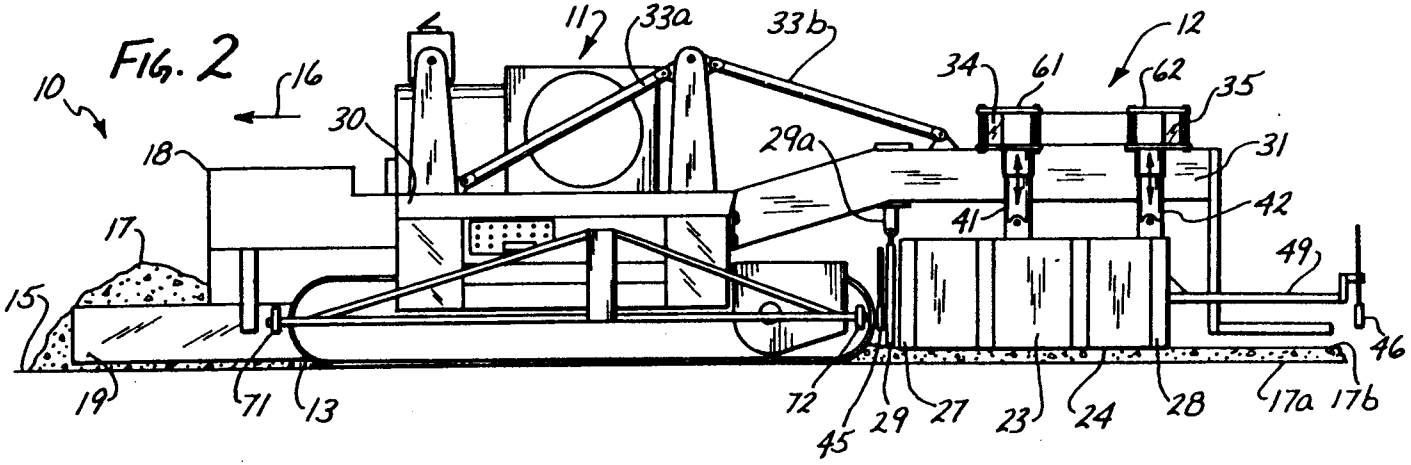
FIG. 2 is a side elevation view of the paving machine.
Figure 3:
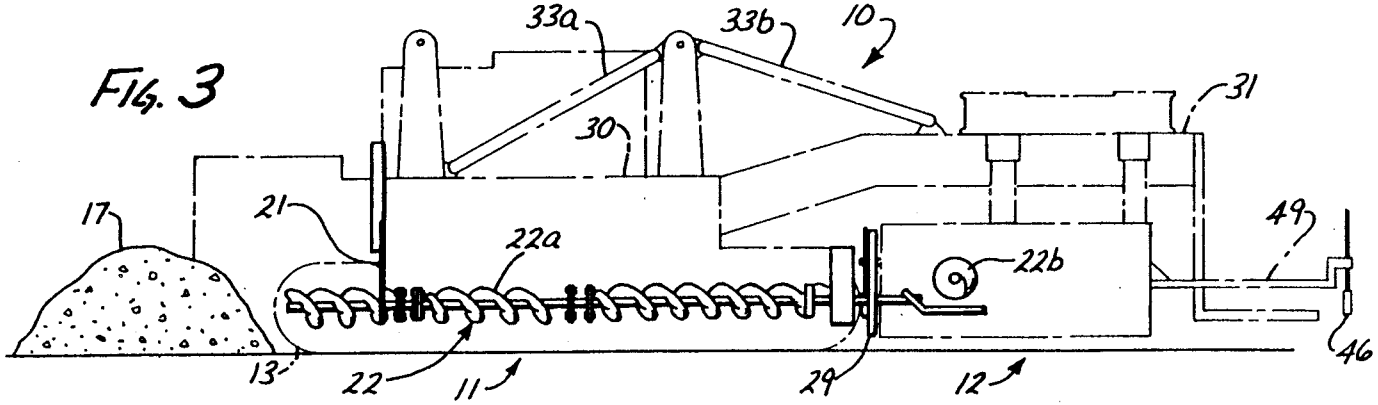
FIG. 3 is a side elevation view showing placement of the augers.
Figure 4:
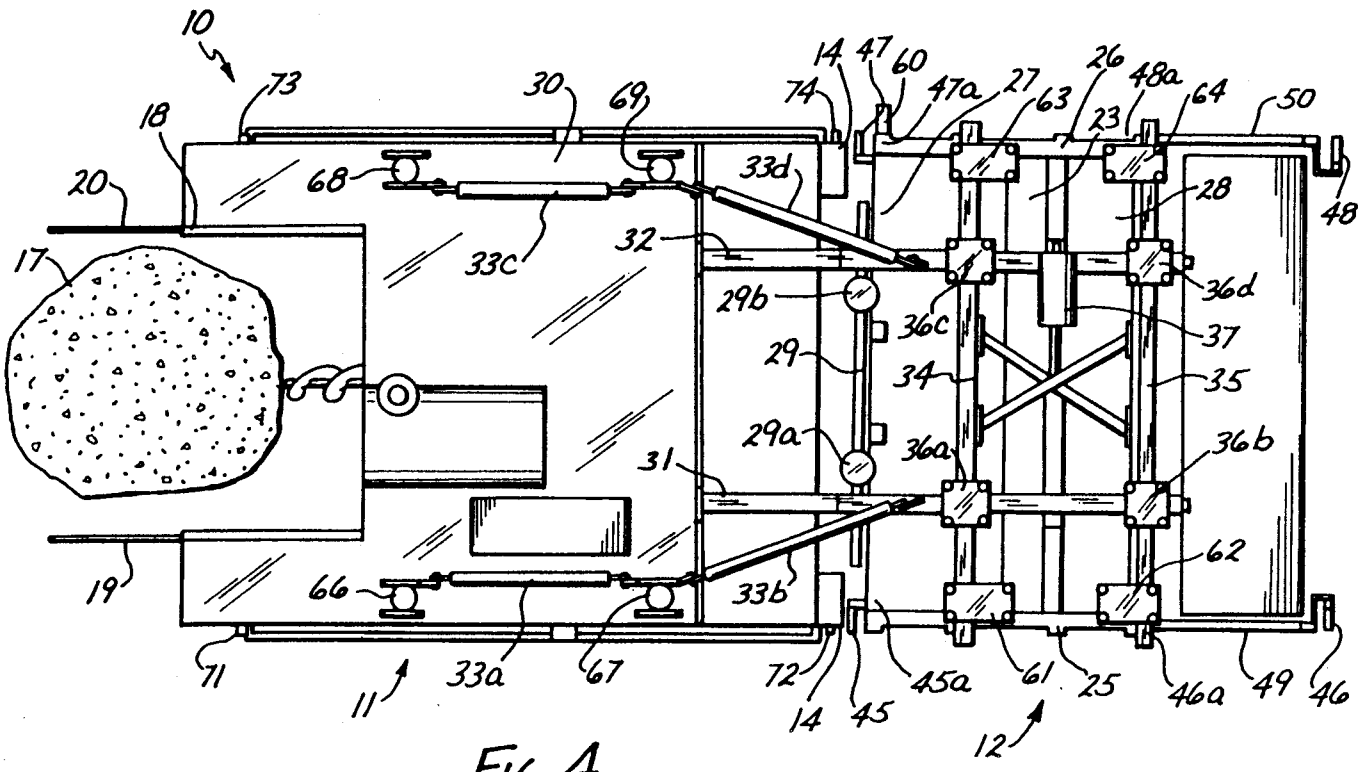
FIG. 4 is top view.

The leading edge portion 27 is slightly higher than the trailing edge portion 28 so that the pan 23 extrudes the concrete mud 17 rearwardly after the concrete mud 17 passes a rearward screed 29 (FIGS. 2–4). The rearward screed 29 is moved to a selected elevation by suitable means such as hydraulic cylinders **29*a* and 29*b* (FIGS. 2 and 4) where it strikes off the concrete mud 17** to provide additional elevation control.

According to a major aspect of the invention, means are provided for mounting the pan assembly 12 on the tractor 11 so that the leading edge portion 27 of the pan 23 is disposed rearwardly of at least one of the left and right tracks 13 and 14, namely the track on the zero clearance side. For the paving machine 10, this is done so that the leading edge portion 27 of the pan 23 is disposed rearwardly of both the left and right tracks 13 and 14, thereby enabling zero clearance paving on either or both sides.

The components that serve as the means for mounting the pan assembly 12 in this manner include a cantilever beam assembly mounted rigidly on a frame structure 30 of the tractor 11. Of course, other mounting components may be employed within the broader inventive concepts disclosed in order to provide an overhead support structure behind the tractor 11 for the pan assembly 12, but the cantilever beam assembly of the paving machine 10 includes left and right cantilever beams 31 and 32 (FIGS. 1–6) that are mounted on the frame structure 30 by suitable means such as bolts (not shown).

The cantilever beam assembly also includes additional supportive members, such as truss members 33*a*–33*d* (FIGS. 1–4), that provide additional strength to the overhead support structure the cantilever beam assembly provides. The resulting support structure supports the pan assembly 12. Being fixed to the tractor 11 it also provides a structure against which to apply the force necessary to hold the pan 23 downwardly at the desired elevation as the concrete mud 17 is extruded beneath it (i.e. at an elevation that forms the slab 17*a* to the desired elevation).

In addition, the mounting components for the paving machine 10 include a lateral beam assembly mounted on the cantilever beam assembly. The lateral beam assembly includes first and second lateral beams 34 and 35 (FIGS. 1–6) that are mounted by suitable means, such as by bearing joints 36*a*–36*b* (FIG. 4), so that the lateral beams 34 and 35 can be moved laterally relative to the cantilever beams 31 and 32. Suitable means, such as a hydraulic cylinder 37 connected between both of the first and second lateral beams 34 and 35 and at least one of the left and right cantilever beams 31 and 32 (FIGS. 4 and 6), operates as depicted by an arrow 38 in FIG. 6 to cause the pan assembly 12 to move laterally as depicted by an arrow 39 in FIG. 7.

Figure 7:
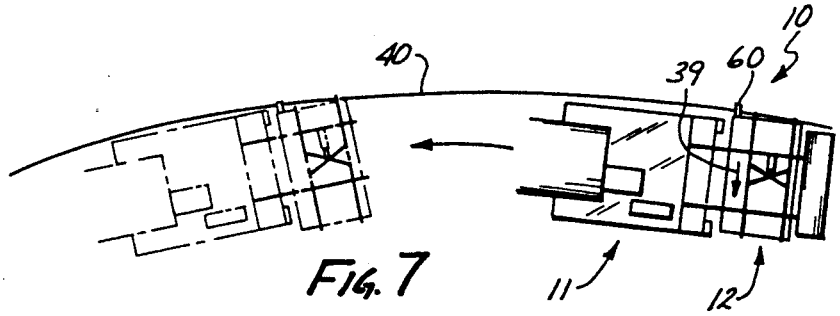
FIG. 7 is diagrammatic view showing lateral movement of the pan assembly during paving along a radius.

The pan assembly 12 is moved in this way as the paving machine 10 moves along a radius as illustrated in FIG. 7 so that the tractor 11 can remain close to the curved right side 40 of the roadway as it paves along that radius, and therefore close to an elevation wire strung along the roadway alongside the curved right side 40. An elevation wire is a known component commonly used in paving, and two elevation wires may be used, a left side elevation wire along the roadway to the left of the direction of travel and a right side elevation wire along the roadway to the right of the direction of travel.

The paving machine 10 in solid lines shows the tractor 11 away from the curved side 40, while the phantom line illustration shows the position that can be maintained by the tractor 11 after the pan assembly has been moved laterally in the direction of the arrow 39. Lateral adjustment of the pan assembly 12 also facilitates paving around obstacles in the roadway as mentioned above.

Considering elevation control in further detail, the paving machine 10 includes four hydraulic cylinders 41-44 (FIGS. 1, 2 and 6) that support the pan assembly 12 from the lateral beams 34 and 35. Each of the hydraulic cylinders 41–44 may be a four-inch stroke, four-inch inside diameter unit mounted within a nine-inch diameter telescoping structure, for example, and each is individually controlled by known-types of hydraulic control components according to the position of respective ones of four sensor devices 45–48 connected to the pan 23 (FIGS. 1–4 and 6). Each of the hydraulic cylinders 41–44 operates to raise or lower the pan assembly 12 and therefore the pan 23 according to the position of the respective one of the sensor devices 45–48 relative to a left side elevation wire and a right side elevation wire.

In other words, each of the sensors is suitably configured to sense its position, and therefore the position of the pan 23, relative to a respective one of the left side and right side elevation wires. For this purpose the paving machine 10 employs known sensor devices and known hydraulic control components similar to those utilized on the earlier model slipform pavers available from CMI Corporation, each sensor device having a feeler or wand (an elongated member about twenty to thirty centimeters long) that is mounted for pivotal movement and biased either upwardly or downwardly toward the elevation wire by suitable means, such as a counterbalancing weight arrangement. This causes the wand to either ride on or underneath and up against a respective one of the left side and right side elevation wires. Other sensing arrangements can be used within the broader inventive concepts disclosed, however, such as optical sensors, but use of commonly employed componentry such as the sensor devices utilized by CMI Corporation may be more convenient and less costly.

The sensor device 45 is a forward sensor device connected by suitable means directly or indirectly but at an adjustable fixed elevation relative to a left portion 45*a* of the leading edge portion 27 of the pan 23, whereas sensor device 46 is a rearward sensor device connected by suitable means directly or indirectly but at an adjustable fixed elevation relative to a left portion 46*a* of the trailing edge 28 of the pan 23 (FIG. 4). Similarly, the sensor device 47 is a forward sensor device similarly connected to a right portion 47*a* of the leading edge 27 and the sensor device 48 is a rearward sensor device similarly connected to a right portion 48*a* of the trailing edge 28.

In that regard, the rearward sensor devices 46 and 48 are connected by respective ones of arm assemblies 49 and 50 (FIG. 1–4). The arm assemblies 49 and 50 position the rearward sensor devices 46 and 48 a substantial distance rearward of the trailing edge 28 (approximately three to five feet, for example). This arrangement provides a lever arm between the rearward sensor devices 46 and 48 and the trailing edge 28 that results in greater sensitivity to trailing edge elevation. In other words, vertical movement of the trailing edge 28 results in a proportionately greater movement of the rearward sensor devices 46 and 48 relative to left and right elevation wires.

Figure 8:
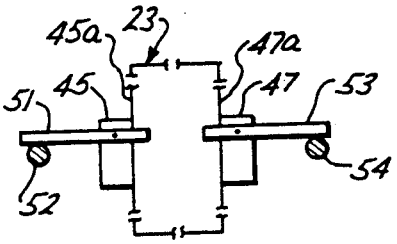
FIG. 8 is a diagrammatic view of two sensor devices riding on left and right elevation wires.

The hydraulic cylinders 41–44 and the sensor devices 45–48 combine to maintain the pan 23 at the desired elevation. When the left portion 45*a* of the leading edge 27 of the pan 23 is higher than the desired elevation, for example, a feeler or wand 51 on the left forward sensor device 45 tends to lift above a left side elevation wire 52 (FIG. 8). But being biased toward the left side elevation wire 52, the wand 51 pivots downwardly toward the left side elevation wire 52 and this causes the sensor device 45 to operate in a known manner to produce a signal which is utilized in a known manner by suitable control components to cause the hydraulic cylinder 41 to lower the left portion 45*a*.

The left portion 45*a* is lowered in this way until the left forward sensor device 45 is in a position relative to the left side elevation wire 52 corresponding to the left portion 45*a* being at the desired elevation. In this NULL position, the wand 51 has pivoted upwardly slightly to turn off the signal. This NULL position can be adjusted by adjusting the elevation of the sensor device 45 relative to the left edge portion 45*a* of the leading edge portion 27 of the pan 23 and the NULL band can be adjusted by adjusting the sensitivity of the sensor device.

Similarly, when the left portion 45*a* of the leading edge 27 of the pan 23 is lower than the desired elevation, the left side elevation wire 52 bears upwardly against the wand 51 so that the wand 51 pivots further upwardly until the left forward sensor device 45 produces a signal which is utilized to cause the hydraulic cylinder 41 to raise the left portion 45*a*. The left portion 45*a* is raised in this way until the wand 51 pivots downwardly again to the NULL position.

The other hydraulic cylinders 42–44 operate in the same manner with respective ones of the other sensor devices 46–48 to maintain the pan 23 at the desired height. In that regard, FIG. 8 also shows the right forward sensor device 47 that is connected to the left portion 47*a* of the leading edge portion 27, the right forward sensor device 47 including a wand 53 that rides on a right side elevation wire 54 to control the hydraulic cylinder 42. The left and right rearward sensor devices 46 and 48 are not illustrated in FIG. 8, but they similarly configured.

In some cases, an elevation wire is used on only one side of the paving machine 10. When paving alongside an existing slab on the left side of the paving machine 10, for example, a known elongated skid structure can be place on the surface of the existing slab and the sensor device 45 adjusted in position so that the wand 51 rides on the skid structure instead of a left side elevation wire. The left rearward sensor device 46 is similarly adjusted so that a wand on the sensor device 46 rides on the skid structure also. A right side elevation wire is still used in such a situation, however, with the wands of the right forward sensor device 47 and the right rearward sensor device 48 riding on it.

Figure 10:
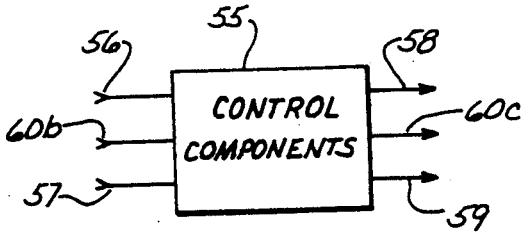
FIG. 10 is a block diagram of the sensor-controlled hydraulics.

The sensor-controlled hydraulics of the paving machine 10 include a suitable known type of control arrangement or circuit 55 illustrated in block diagram form in FIG. 10. Signals from the sensor devices 45–48 are transmitted to an input 56 by suitable means such as over wires. Signals from additional sensor devices on the tractor 11 (subsequently described) are also transmitted to an input 57. The signals received at the input 56 are processed in a known way by the control components to selectively activate the hydraulic cylinders 41–44 over hydraulic lines connected to an output 58. In addition, the signals received at the input 57 are processed in a known way by the control components to selectively activate four hydraulic cylinders 66–69 on the tractor 11 over hydraulic lines connected to an output 59.

Figure 9:
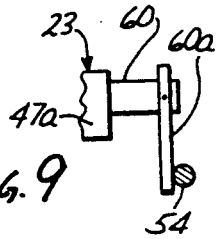
FIG. 9 is a diagrammatic view of an additional sensor device for controlling lateral movement of the pan assembly.

Sensor-controlled hydraulics are used for lateral movement of the pan assembly 12 as well. Thus, an additional sensor device 60 similar to the sensor devices 45–48 is connected to the right side portion 47*a* of the leading edge portion 27 of the pan 23 (FIGS. 4, 7, and 9). It includes a wand 60*a* similar to the wand 53 of the sensor device 47 except that the wand 60*a* is mounted so that it extends vertically downwardly. A known type of counterbalancing weight arrangement (not shown) biases the wand 60*a* toward the right side elevation wire 54, and the sensor device 60 is adjusted in position relative to the pan assembly 12 so that the wand 60*a* rides along the inner side of the right side elevation wire 54 when the pan assembly 12 is at a desired distance from the right side elevation wire 54. Of course, the wand 60*a* could, in the alternative, ride on an inner surface of an existing slab when engaged in zero clearance paving against the existing slab.

In either case, when the wand 60*a* is in a position corresponding to the pan assembly 12 being at a desired distance from the elevation wire or the existing slab, the wand 60*a* is in a NULL position. The sensor device 60 produces signals indicative of the wand 60*a* moving left or right of this position, toward or away from the right side elevation wire 54 or the existing slab. These signals are transmitted by suitable means such as wires to an input 60*b* of the control circuit 55 (FIG. 10) where they are processed in a known way by the control components selectively activate the hydraulic cylinder 37 over a hydraulic line connected to an output 60*c* in order to move the pan assembly laterally.

Thus, the above sensor-controlled hydraulics may use known components that operate in a known way. But in comparison to the prior art, the pan assembly 12 is positioned advantageously relative to the tractor 11 (behind at least one and preferably both of the tracks), the elevation sensor devices are positioned advantageously relative to the pan 23, more sensor devices are employed (preferably one at each corner of the pan 23), and at least one additional sensor device is provided for use in controlling lateral position of pan assembly 12 relative to an elevation wire.

In addition to being adjustable in position relative to the tractor 11, the pan assembly 12 can be in width. Thus, the hydraulic cylinders 41–42 ar on the first and second lateral beams 34 and 35 by suitable means, such as adjustable joints 61–64 in FIGS. 2, 4, and 6, so that a user can adjust the position of the adjustable joints 61–64 relative to the first and second lateral beams 34 and 35. By loosening bolts on the adjustable joints 61–64, adjusting their position, and then retightening the bolts, a user can adjust the pan assembly 12 in order to accommodate different width pans.

Additional elevation control is also accomplished by using an independently adjustable frame structure 30 on the tractor 11. Four hydraulic cylinders 66–69 (FIGS. 4, 5 and 6) support the frame structure 30, and these hydraulic cylinders combine with four sensor devices 71–74 (FIGS. 1, 2, 4, and 5) in a manner similar to that employed for the pan assembly 12. The sensor devices 71–74 are similar to the sensor devices previously described, including wands that ride on the elevation wires, and each one of the sensor devices 71–74 produces signals that are transmitted to the input 57 of the control circuit 55 described previously with reference to FIG. 10. The control circuit 55 then operates the hydraulic cylinders 66–69 accordingly over hydraulic lines (not shown) connected to the output 59 of the control circuit 55. As the tractor 11 inches forward in the process of paving, these components operate to maintain the frame structure 30 at a desired elevation while the sensor controlled hydraulics of the pan assembly 12 make any fine adjustments in the elevation of the pan 23 that may be desirable.

Thus, the invention mounts a pan assembly on a tractor so that the pan is entirely behind the tracks. It uses leading edge sensors and trailing edge sensors on the pan in positions that avoid the lever arm problem of the prior art and better reflect pan position. Zero and minimum clearance paving is more convenient and elevation control improved while lateral movement of the pan assembly as well as width adjustment further enhance operation.

Although an exemplary embodiment of the invention has been shown and described, many changes, modifications, and substitutions may be made by one having ordinary skill in the art without necessarily departing from the spirit and scope of the invention.

What is claimed is:

1. A paving machine, comprising:

a tractor for moving a pan assembly in a desired direction of travel on a roadway to be paved, the tractor having left and right tracks;

a pan assembly for forming a quantity of concrete mud into a slab having a desired width and elevation as the tractor moves the pan assembly on the roadway, the pan assembly having a pan that extends laterally substantially the full desired width and rearwardly from a leading edge portion of the pan to a trailing edge portion of the pan;

means for mounting the pan assembly on the tractor so that the leading edge portion of the pan is disposed rearwardly of at least one of the left and right tracks;

the tractor including a frame structure and the means for mounting the pan assembly including a cantilever beam attached rigidly to the frame structure for use in supporting the pan assembly so that the weight of the tractor can be used to bear downwardly on the pan in order to control the thickness of the slab.

2. A paving machine as recited in claim 1, wherein:

the means for mounting the pan assembly mounts the pan assembly on the tractor so that the leading edge portion of the pan is disposed rearwardly of both the left and right tracks.

3. A paving machine as recited in claim 1, wherein:

the tractor includes a frame structure; and the cantilever beam is mounted on the frame structure, the cantilever beam assembly supporting the pan assembly so that the pan assembly is disposed rearwardly of the tractor.

4. A paving machine as recited in claim 1, wherein the means for mounting the pan assembly on the tractor includes:

means for adjusting the elevation of the pan in order to maintain the desired elevation of the slab.

5. A paving machine as recited in claim 4, wherein the means for adjusting the elevation of the pan includes:

at least one hydraulic cylinder supporting the pan assembly.

6. A paving machine as recited in claim 5, wherein:

the hydraulic cylinder supports the pan assembly from the cantilever beam.

7. A paving machine as recited in claim 4, wherein the means for adjusting the elevation of the pan assembly includes:

means for sensing when the pan is at the desired elevation.

8. A paving machine as recited in claim 7, wherein the means for sensing when the pan is at the desired elevation includes:

a plurality of sensor devices connected to the pan that are configured to ride on an elevation wire strung at a known elevation alongside the roadway.

9. A paving machine as recited in claim 8, wherein the plurality of sensor devices includes:

a forward sensor device connected to the leading edge portion of the pan; and a rearward sensor device connected to the trailing edge portion of the pan.

10. A paving machine as recited in claim 9, wherein the means for sensing includes:

an arm assembly on which the rearward sensor device is mounted, the arm assembly being configured and connected to the trailing edge portion of the pan so that the rearward sensor device is disposed rearwardly of the trailing edge portion a substantial distance.

11. A paving machine as recited in claim 8, wherein the plurality of sensor devices includes:

left and right forward sensor devices, the left forward sensor device being connected to a left portion of the leading edge portion of the pan and the right forward sensor device being connected to a right portion of the leading edge portion of the pan; and left and right rearward sensor devices, the left rearward sensor device being connected to a left portion of the trailing edge portion of the pan and the right rearward sensor device being connected to a right portion of the trailing edge portion of the pan.

12. A paving machine as recited in claim 11, the means for sensing includes:

left and right arm assemblies on which the left and right rearward sensor devices are mounted, the left and right arm assemblies being configured and connected to respective ones of a left portion of the trailing edge portion of the pan and a right portion of the trailing edge portion of the pan so that both the left and right rearward sensor devices are disposed rearwardly of the trailing edge portion a substantial distance.

13. A paving machine as recited in claim 4, wherein the means for adjusting the elevation of the pan includes:

means for adjusting the elevation of the frame structure on the tractor.

14. A paving machine as recited in claim 13, wherein the means for adjusting the elevation of the pan includes:

first and second forward sensor devices for sensing a wire strung alongside the roadway, the first and second forward sensor devices being mounted on respective ones of a left portion and a right portion of a forward portion of the frame structure on the tractor; and first and second rearward sensor devices for sensing the wire, the first and second rearward sensor devices being mounted on respective ones of a left portion and a right portion of a rearward portion of the frame structure on the tractor.

15. A paving machine as recited in claim 1, wherein the means for mounting the pan assembly on the tractor includes:

means for moving the pan assembly laterally.

16. A paving machine as recited in claim 15, wherein the means for mounting the pan assembly on the tractor includes:

a lateral beam mounted on the cantilever beam for supporting the pan assembly, the lateral beam being mounted on the cantilever beam to enable it to be moved laterally relative to the cantilever beam.

17. A paving machine as recited in claim 16, further comprising:

means for moving the lateral beam to a selected position.

18. A paving machine as recited in claim 17, wherein the means for moving the lateral beam includes:

a hydraulic cylinder operatively connected between the cantilever beam and the lateral beam.

19. A paving machine as recited in claim 1, wherein the means for mounting the pan assembly on the tractor includes:

means for adjusting the width of the pan assembly.

20. A paving machine as recited in claim 1, further comprising:

a rear screed located intermediate the tracks and the leading edge portion of the pan.

21. A paving machine as recited in claim 1, wherein the means for mounting the pan assembly includes adjusting means acting between the cantilever beam and the pan assembly for adjusting the height of the pan assembly relative to the cantilever beam.

22. A paving machine as recited in claim 21, wherein the paving machine includes sensing means for sensing elevation of the pan assembly and the adjusting means is responsive to the sensing means to adjust the height of the pan assembly.

23. A paving machine comprising:

a tractor having left and right roadway contacting members for moving the tractor along a roadway to be paved;

a pan including means for forming concrete mud into a slab having a desired width, said means including a downwardly facing surface that extends laterally for substantially said desired width, said downwardly facing surface having a leading edge portion and a trailing edge portion;

means for coupling the pan to the tractor to allow vertical movement of the pan relative to the tractor, said leading edge portion of said downwardly facing surface being disposed rearwardly of the left and right roadway contacting members;

sensor means for sensing the elevation of said downwardly facing surface; and means responsive to said sensor means for independently adjusting the height of the left and right sides of the leading and trailing edge portions of the downwardly facing surface relative to the tractor to thereby control the elevation of the slab.

24. A paving machine as defined in claim 23 wherein said sensor means includes first, second, third and fourth sensors adjacent the left and right sides of the leading edge portion of the downwardly facing surface and the left and right sides of the trailing edge portion of the downwardly facing surface, respectively, and said adjusting means includes first, second, third and fourth actuators for independently controlling the height of the left and right sides of the leading edge portion of the downwardly facing surface and the height of the left and right sides of the trailing edge portion of the downwardly facing surface, respectively, said first, second, third and fourth actuators being responsive to the first, second, third and fourth sensors, respectively.

25. A paving machine as defined in claim 23 wherein the leading edge portion of the downwardly facing surface is higher than the trailing edge portion of the downwardly facing surface so that the pan extrudes the concrete mud rearwardly.

26. A paving machine as defined in claim 23 wherein the coupling means includes a cantilever beam coupled to the tractor and means for coupling the pan to the cantilever beam.

27. A paving machine as defined in claim 26 wherein the adjusting means is coupled to the pan and the cantilever beam.

28. A paving machine comprising:

a tractor having left and right roadway contacting members for moving the tractor along a roadway to be paved;

a pan including means for forming concrete mud into a slab having a desired width, said means including a downwardly facing surface that extends laterally for substantially said desired width, said downwardly facing surface having a leading edge portion and a trailing edge portion;

means for coupling the pan to the tractor to allow vertical and lateral movement of the pan relative to the tractor, said leading edge portion of said downwardly facing surface being disposed rearwardly of the left and right roadway contacting members;

sensor means for sensing the elevation of said downwardly facing surface;

means responsive to said sensor means for independently adjusting the height of the left and right sides of the leading and trailing edge portions of the downwardly facing surface relative to the tractor to thereby control the elevation of the slab; and means for moving the pan laterally of the tractor.

29. A paving machine as defined in claim 28 wherein said sensor means includes first, second, third and fourth sensors adjacent the left and right sides of the leading edge portion of the downwardly facing surface and the left and right sides of the trailing edge portion of the downwardly facing surface, respectively, and said adjusting means includes first, second, third and fourth actuators for independently controlling the height of the left and right sides of the leading edge portion of the downwardly facing surface and the height of the left and right sides of the trailing edge portion of the downwardly facing surface, respectively, said first, second, third and fourth actuators being responsive to the first, second, third and fourth sensors, respectively.

30. A paving machine as defined in claim 28 wherein the leading edge portion of the downwardly facing surface is higher than the trailing edge portion of the downwardly facing surface so that the pan extrudes the concrete mud rearwardly.

31. A paving machine as defined in claim 28 wherein the coupling means includes a cantilever beam coupled to the tractor and means for coupling the pan to the cantilever beam.

32. A paving machine as defined in claim 28 wherein the means for moving the pan laterally is coupled to the pan and the cantilever beam.

33. A paving machine comprising:

a tractor for moving a pan assembly in a desired direction of travel on a roadway to be paved, the tractor having left and right roadway contacting members;

a pan assembly for forming a quantity of concrete mud into a slab having a desired width and elevation as the tractor moves the pan assembly on the roadway, the pan assembly having a pan that extends laterally substantially the full desired width and rearwardly from a leading edge portion of the pan to a trailing edge portion of the pan;

means for mounting the pan assembly on the tractor so that the leading edge portion of the pan is disposed rearwardly of at least one of the left and right roadway contacting members; and the tractor including a frame structure and the means for mounting the pan assembly including a cantilever beam attached rigidly to the frame structure for use in supporting the pan assembly so that the weight of the tractor can be used to bear downwardly on the pan in order to control the thickness of the slab.

* * * * *